US008626012B2

(12) United States Patent
Yoshioka

(10) Patent No.: US 8,626,012 B2
(45) Date of Patent: Jan. 7, 2014

(54) IMAGE FORMING APPARATUS AND IMAGE FORMING METHOD

(75) Inventor: Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 13/187,050

(22) Filed: Jul. 20, 2011

(65) Prior Publication Data

US 2012/0219309 A1 Aug. 30, 2012

(30) Foreign Application Priority Data

Feb. 24, 2011 (JP) ..... 2011-038164

(51) Int. Cl.
*G03G 15/00* (2006.01)
*G03G 15/01* (2006.01)
*G03G 15/16* (2006.01)

(52) U.S. Cl.
USPC ..... 399/45; 399/49; 399/66

(58) Field of Classification Search
None
See application file for complete search history.

(56) References Cited

U.S. PATENT DOCUMENTS

| | | | | |
|---|---|---|---|---|
| 2007/0171444 A1 | 7/2007 | Washino | | |
| 2007/0172244 A1 * | 7/2007 | Lee et al. | | 399/45 |
| 2008/0160435 A1 | 7/2008 | Lim et al. | | |

FOREIGN PATENT DOCUMENTS

| | | | | | |
|---|---|---|---|---|---|
| EP | 2112559 | A | | 10/2009 | |
| EP | 2154578 | A | | 2/2010 | |
| JP | 2004-094282 | A | | 3/2004 | |
| JP | 2007-004066 | A | | 1/2007 | |
| JP | 2007-004066 | A | * | 1/2007 | G03G 15/00 |
| JP | 2009-103885 | A | | 5/2009 | |
| JP | 2010-079106 | A | * | 4/2010 | G03G 15/01 |
| JP | 2010079106 | A | | 4/2010 | |
| JP | 2010-169958 | A | | 8/2010 | |
| JP | 2010-191355 | A | | 9/2010 | |

OTHER PUBLICATIONS

Australian Office Action dated Jul. 1, 2013 issued in Patent Application No. 2011218601.

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

An image forming apparatus includes a toner image forming device that forms a toner image by using at least one of a plurality of toners that include a color toner and a first transparent toner; an intermediate transfer body to which the toner image is transferred; a second transfer unit that transfers the toner image to a recording medium; and a controller that acquires characteristic information that represents a characteristic of in-plane resistance variation of a currently-used recording medium before the toner image forming device forms the toner image, and if the characteristic information indicates that the in-plane resistance variation of the currently-used recording medium is larger than a predetermined value, controls the toner image forming device so that the toner image forming device forms a transparent toner image in such a way that a color toner image is superimposed on the transparent toner image on the intermediate transfer body.

8 Claims, 8 Drawing Sheets

FIG. 5
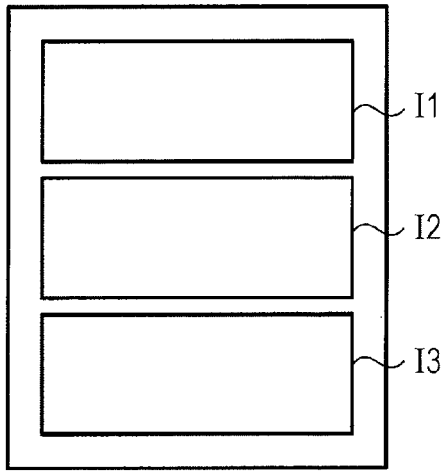
FIG. 6
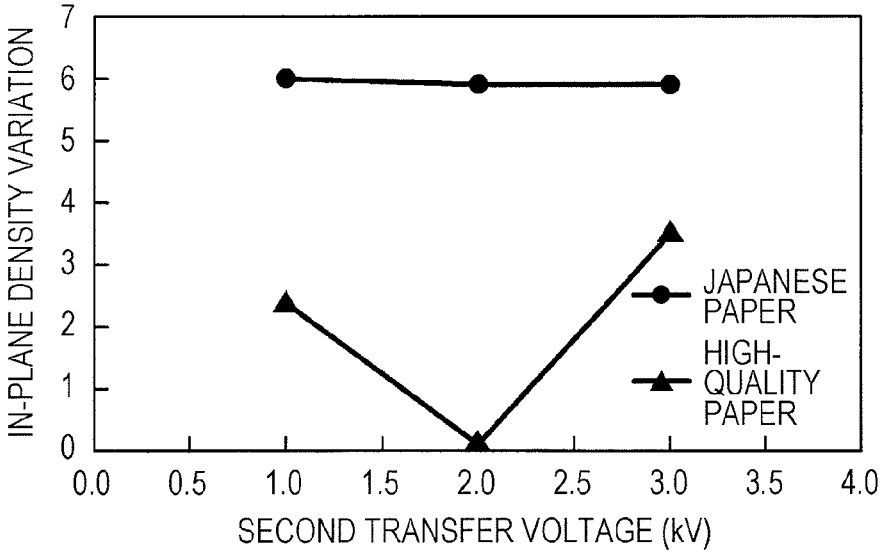
FIG. 7
| NO. | PRODUCT NAME | RESISTANCE VARIATION |
|---|---|---|
| 1 | AAA | 0 |
| 2 | BBB | 1 |
| 3 | CCC | 1 |
| ... | ... | ... |

IMAGE FORMING APPARATUS AND IMAGE FORMING METHOD

CROSS-REFERENCE TO RELATED APPLICATIONS

This application is based on and claims priority under 35 USC 119 from Japanese Patent Application No. 2011-038164 filed Feb. 24, 2011.

BACKGROUND

Technical Field

The present invention relates to an image forming apparatus and an image forming method.

SUMMARY

According to an aspect of the present invention, an image forming apparatus includes a toner image forming device that forms a toner image by using at least one of a plurality of toners that include a color toner and a first transparent toner that has a viscoelasticity higher than a viscoelasticity of the color toner; an intermediate transfer body to which the toner image formed by the toner image forming device is transferred; a second transfer unit that transfers the toner image transferred to the intermediate transfer body to a recording medium; and a controller that acquires characteristic information that represents a characteristic of in-plane resistance variation of a currently-used recording medium before the toner image forming device forms the toner image, and if the characteristic information indicates that the in-plane resistance variation of the currently-used recording medium is larger than a predetermined value, controls the toner image forming device so that the toner image forming device forms a transparent toner image by using the first transparent toner in such a way that a color toner image formed by using the color toner is superimposed on the transparent toner image on the intermediate transfer body.

BRIEF DESCRIPTION OF THE DRAWINGS

An exemplary embodiment of the present invention will be described in detail based on the following figures, wherein:

FIG. 5 is a schematic view illustrating examples of three images formed on a recording medium by using different second transfer voltages;

FIG. 6 is a graph illustrating an example of a measurement result of the in-plane density variation;

FIG. 7 illustrates an example of a table storing correspondence between an identifier of a recording medium and information representing whether the in-plane resistance variation of the recording medium is larger than a predetermined value;

DETAILED DESCRIPTION

Exemplary Embodiment

Structure

Figure 1:
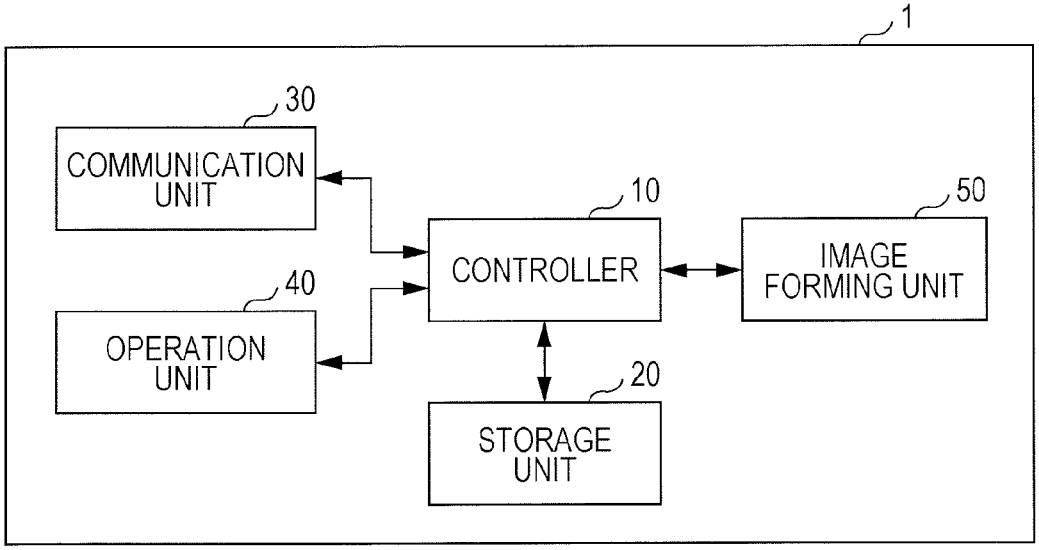
FIG. 1 is a block diagram of an image forming apparatus according to the exemplary embodiment of the present invention.

Hereinafter, an exemplary embodiment of the present invention will be described with reference to the drawings. FIG. 1 is a block diagram of an image forming apparatus 1 according to the exemplary embodiment of the present invention. In the present exemplary embodiment, the image forming apparatus 1 is a printer. The image forming apparatus 1 includes a controller 10, a storage unit 20, a communication unit 30, an operation unit 40, and an image forming unit 50.

The controller 10 includes a central processing unit (CPU), a read only memory (ROM), and a random access memory (RAM) (not shown). The CPU executes a control program stored in the ROM or the storage unit 20, thereby controlling various members of the image forming apparatus 1. The storage unit 20 is a non-volatile storage device, such as a hard disk drive (HDD), and stores various programs and data. The communication unit 30 is an interface for performing communication with external apparatuses, such as a personal computer, through a USB cable or a communication network (such as a telephone line or a local area network (LAN)). The operation unit 40 includes a display device, a transparent touch panel superposed on a screen of the display device, and operation keys. The operation unit 40 receives an operation from a user through the touch panel and the operation keys, and provides information to the user by displaying an image on the display device. The image forming unit 50 forms an image on a recording medium (for example, a sheet of paper) by using a toner on the basis of an image signal supplied by the controller 10.

Figure 2:
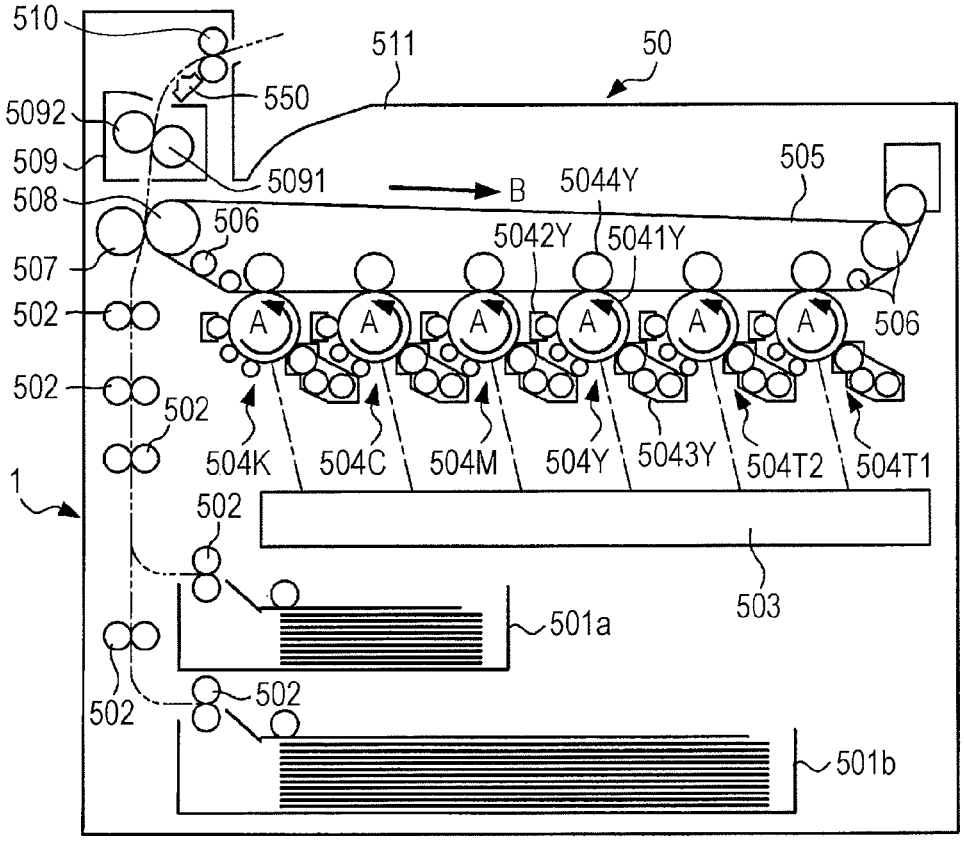
FIG. 2 is a schematic view of an image forming unit.

Next, the structure of the image forming unit 50 will be described in detail. FIG. 2 is a schematic view of the image forming unit 50. Two-dot chain line in FIG. 2 illustrates a transport path of a recording medium.

The image forming unit 50 includes two sheet feeders 501*a* and 501*b*. The sheet feeders 501*a* and 501*b* are capable of containing different types (material and size) of recording media. For example, the sheet feeder 501*a* may contain high-quality paper, and the sheet feeder 501*b* may contain Japanese paper. The high-quality paper is an example of a recording medium having a small in-plane resistance variation, and the Japanese paper is an example of a recording medium having a large in-plane resistance variation. Here, the in-plane resistance variation is a quantity that represents two-dimensional variation of the electrical resistance (hereinafter simply referred to as a resistance) of a recording medium in the in-plane direction of the recording medium (i.e., not in the thickness direction). The in-plane resistance variation is calculated, for example, as the variance of the in-plane distribution of the resistance of the recording medium. Each of the sheet feeders 501*a* and 501*b* feeds recording media therefrom one by one at timings instructed by the controller 10. Sheet transport rollers 502 transport the recording medium fed from the sheet feeder 501*a* or 501*b* to a second transfer unit, which is constituted by a second transfer roller 507 and a backup roller 508.

An exposure device 503 includes a laser light source and a polygon mirror. On the basis of an image signal supplied by the controller 10, the exposure device 503 irradiates toner image forming units 504Y, 504M, 504C, 504K, 504T1, and 504T2 with laser beams. In the present exemplary embodiment, the toner image forming units 504Y, 504M, 504C, 504K, 504T1, and 504T2 constitute a toner image forming device that forms a toner image by using at least one of plural toners.

As described below in detail, the toner image forming units 504Y, 504M, 504C, and 504K respectively develop latent images, which have been formed on photoconductor drums due to laser irradiation by the exposure device 503, by using yellow (Y), magenta (M), cyan C, and black (K) color toners and thereby form color toner images. The toner images formed by the toner image forming units 504Y, 504M, 504C, and 504K are transferred (first-transferred) onto an intermediate transfer belt 505 so as to overlap. The color toners described above have the same viscoelasticity, because the compositions of the color toners are the same except for the coloring agent such as pigment. That is, the difference in the viscoelasticity between the color toners is negligibly small as compared with the values of the viscoelasticities of the color toners.

The viscoelasticity of a toner is represented by, for example, the storage modulus. Because the storage modulus changes with the temperature, the viscoelasticity of a toner is determined so that that toner has a certain storage modulus at a predetermined temperature by using a curve representing the relationship between storage modulus and temperature. In the present exemplary embodiment, the storage modulus of a color toner is adjusted to, for example, about $5\times10^4$ Pa at 80° C. (which is an example of a predetermined temperature). The viscoelasticity (storage modulus) is adjusted by, for example, changing the type and amount of inorganic powder (inorganic particles) added to toner particles. The inorganic particles may be known inorganic particles, such as silica particles, titanium oxide particles, alumina particles, cerium oxide particles, or particles obtained by hydrophobizing the surfaces of such particles. A combination of two types of such known inorganic particles may be used. Surface-treated silica particles may be used. For example, silica particles that are surface-treated by using a silane coupling agent, a titanium coupling agent, a silicone oil, or the like may be used.

The gloss of a toner that is fixed on a recording medium is influenced by the viscoelasticity of the toner. The higher the viscoelasticity, the lower the gloss. Therefore, the viscoelasticity of the toner may be adjusted so that the toner has a predetermined gloss when a predetermined amount of toner is fixed on a specified recording medium (sheet). For example, the value of the viscoelasticity (storage modulus) of the color toners described above (about $5\times10^4$ Pa at 80° C.) is adjusted so that the gloss that is measured at a measurement angle of 60° is 65±5 when a toner (having a volume mean diameter=5.8 μm) in the amount in the range of 3.0 g/m$^2$ to 4.0 g/m$^2$ is fixed at 140° C. on a high-quality coated paper having a basis weight of 127 g/m$^2$. Therefore, the storage modulus of the color toners may be usually in the range of $1\times10^4$ Pa to $1\times10^6$ Pa at 80° C., although the storage modulus may vary depending on the specified recording medium and the predetermined gloss. The volume mean diameter of a toner is measured, for example, by using a Coulter Multisizer II (made by Beckman Coulter Inc.) with an aperture diameter of 50 μm. The value 5.8 μm of the volume mean diameter of the toner is an example, and the volume mean diameter may have another value. In this case, the amount of toner per unit area of the sheet may be optimized so as to obtain a desired gloss.

The toner image forming unit 504T1 and the toner image forming unit 504T2 respectively form transparent toner images by developing latent images, which have been formed on the photoconductor drums by laser beam irradiation performed by the exposure device 503, by using a first transparent toner and a second transparent toner, and transfer the toner images to the intermediate transfer belt 505.

The first and second transparent toners are respectively made, for example, by adding silicon dioxide ($SiO_2$) and titanium dioxide ($TiO_2$) to a low-molecular weight polyester resin. The first and second transparent toners do not include a coloring agent such as a pigment (i.e., the pigment content is equal to or smaller than 0.01 mass %), and becomes colorless and transparent after being fixed. The first transparent toner and the second transparent toner have different viscoelasticities. To be specific, in the present exemplary embodiment, the storage modulus of the first transparent toner, which represents the viscoelasticity, is adjusted to about $2\times10^5$ Pa at 80° C., and the storage modulus of the second transparent toner, which represents the viscoelasticity, is adjusted to about $5\times10^4$ Pa at 80° C. That is, in the present exemplary embodiment, the first transparent toner has a viscoelasticity that is higher than (in this example, about four times higher than) that of the color toners, and the second transparent toner has a viscoelasticity corresponding to that of the color toners. (In other words, the difference between the viscoelasticities of the second transparent toner and the color toners is negligibly small as compared with the value of the viscoelasticity of the second transparent toner or the color toners). Such viscoelasticity of the first transparent toner is obtained by adjusting the type and amount of the inorganic powder (inorganic particles) added to the toner particles as described above. The composition of the second transparent toner is the same as that of the color toners except that the second transparent toner does not include a coloring agent such as a pigment. When the first transparent toner described above as an example (having a volume mean diameter of 5.8 μm and a storage modulus of about $2\times10^4$ Pa at 80° C.) with an amount in the range of 3.0 g/m$^2$ to 4.0 g/m$^2$ is fixed on high-quality coated paper having a basis weight of 127 g/m$^2$ at 140° C., the gloss of the toner measured at a measurement angle of 60° is about 15.

As illustrated in FIG. 2, in the present exemplary embodiment, the toner image forming units 504T1, 504T2, 504Y, 504M, 504C, and 504K are arranged along a lower part of the intermediate transfer belt 505, which rotates in the direction indicated by arrow B (clockwise). The toner image forming units 504T1 and 504T2 for the transparent toners are disposed upstream of the toner image forming units 504Y, 504M, 504C, and 504K with respect to the direction in which the lower part of the intermediate transfer belt 505 moves. To be specific, the toner image forming units 504T1, 504T2, 504Y, 504M, 504C, and 504K are arranged in this order from the upstream side in the direction in which the intermediate transfer belt 505 moves, and the toner images in corresponding colors are transferred onto the intermediate transfer belt 505 in this order. Therefore, in a case where a transparent toner image is formed by the toner image forming unit 504T1 or 504T2, a transparent toner image is transferred onto the intermediate transfer belt 505, and then color toner images formed by the toner image forming units 504Y, 504M, 504C, and 504K are transferred onto the transparent toner image so as to overlap. The structures of the toner image forming units 504T1, 504T2, 504Y, 504M, 504C, and 504K are substantially the same, except that they use different toners. When it is not necessary to distinguish between these toner image forming units, the toner image forming units will be referred to as "toner image forming units 504" by omitting the suffix representing the color of toner.

Each of the toner image forming units 504 includes a photoconductor drum 5041, a charger 5042, a developing device 5043, and a first transfer roller 5044. The photoconductor drum 5041, which is an example of an image carrier having a charge-generating layer and a charge-transporting layer, is rotated in the direction of arrow A of FIG. 2 (counterclockwise) by a drive unit (not shown). The charger 5042 charges a surface of the photoconductor drum 5041 to a predetermined potential. The charged surface of the photoconductor drum 5041 is exposed to a laser beam (exposure beam) emitted by the exposure device 503, whereby an electrostatic latent image is formed. The developing device 5043, which is a tandem-type developing device in this example, contains toner (such as the yellow toner or the first transparent toner), which is a developer, and generates a potential difference (development bias) between the developing device 5043 and the surface of a corresponding photoconductor drum 5041. The toner contained in the developing device 5043 is attached to the electrostatic latent image, which has been formed on the surface of the photoconductor drum 5041, due to the potential difference, whereby a toner image is formed on the surface of the photoconductor drum 5041. The first transfer roller 5044 generates a potential difference between the intermediate transfer belt 505 and the photoconductor drum 5041 at a position at which the intermediate transfer belt 505 faces the photoconductor drum 5041. The toner image on the photoconductor drum 5041 is transferred onto the intermediate transfer belt 505 due to the potential difference. The developer contained in the developing device 5043 may be a two-component developer including a toner and a carrier.

The intermediate transfer belt 505 is an endless belt that is supported by belt transport rollers 506 with a tension. At least one of the belt transport rollers 506 has a drive unit, and rotates the intermediate transfer belt 505 in a direction indicated by arrow B of FIG. 2. At this time, other belt transport rollers 506 that do not have a drive unit are rotated by the intermediate transfer belt 505. As the intermediate transfer belt 505 rotates in the direction indicated by arrow B, the toner images, which have been transferred onto the intermediate transfer belt 505 by the toner image forming units 504, move to the second transfer unit, which is constituted by the second transfer roller 507 and the backup roller 508.

The second transfer roller 507 and the backup roller 508 generate a potential difference between the intermediate transfer belt 505 and the second transfer roller 507 at a position at which the intermediate transfer belt 505 faces the recording medium. Due to the potential difference (hereinafter referred to as "second transfer voltage"), the toner images on the intermediate transfer belt 505 are transferred (second-transferred) to a recording medium that is nipped between the intermediate transfer belt 505 and the second transfer roller 507. It is necessary that the second transfer voltage be at an appropriate level because, if the second transfer voltage is too low, an electric field generated between the second transfer roller 507 and the intermediate transfer belt 505 is not sufficiently strong and the toners on the intermediate transfer belt 505 are not normally transferred to the recording medium, and if the second transfer voltage is too high, discharge occurs between the second transfer roller 507 and the intermediate transfer belt 505 and the toners are not normally transferred to the recording medium. The second transfer voltage is usually determined at an optimal value in accordance with the basis weight (weight per unit area) of the recording medium. The basis weight of the recording medium differs depending on the material and the thickness of the recording medium.

The recording medium, onto which the toner images have been transferred, is transferred to a fixing unit 509. The fixing unit 509 includes a heating roller 5091 and a pressing roller 5092. The recording medium is heated and pressed while passing between the heating roller 5091 and the pressing roller 5092, and thereby the toner images, which have been transferred to the recording medium by the second transfer unit, are fixed on the recording medium. The recording medium, on which the toner images have been fixed, passes between output rollers 510 and is output to an output tray 511 that is disposed on the upper surface of the image forming unit 50.

The image forming unit 50 includes an in-line sensor unit 550 disposed between the fixing unit 509 and the output rollers 510. The in-line sensor unit 550 measures the optical density of a toner image fixed on the recording medium. Therefore, the in-line sensor unit 550 is disposed downstream of the second transfer unit in the transport direction of the sheet. Here, the optical density (hereinafter simply referred to as "density") refers to the density of an image that is defined by, for example, $D=\log_{10}(1/R)$, where R is the reflectivity of a relevant part of the image. The in-line sensor unit 550 may include a light emitting member that irradiates a transported recording medium with light having a predetermined intensity, a CCD optical sensor that receives reflected light reflected from the recording medium, and a mirror that guides the reflected light to the optical sensor (see, for example, FIG. 11 of Japanese Unexamined Patent Application Publication 2010-169958 (Patent Document 2)). The optical sensor transmits a signal representing the intensity of the received reflected light to the controller 10. The controller 10 calculates the optical density on the basis of the intensity of the reflected light represented by the signal received from the in-line sensor unit 550 and the predetermined intensity of light emitted from the light emitting member.

The in-line sensor unit 550 measures the densities (reflectivities) of parts of a toner image formed on the recording medium, and thereby obtains the two-dimensional density distribution of the toner image. For this purpose, the in-line sensor unit 550 may be configured to be capable of scanning the recording medium with a light beam, which is emitted by a light emitting member, by deflecting the light beam with a polygon mirror or the like in a direction that intersects the transport direction of the recording medium (i.e., the direction in which the rotation axes of the sheet transport rollers 502 extend). Alternatively, plural light emitting members and optical sensors may be arranged in a direction that intersects the transport direction of the recording medium. In other words, the in-line sensor unit 550 may have any structure as long as the in-line sensor unit 550 is capable of generating a signal that represents the two-dimensional density distribution of a toner image formed on the recording medium. The in-line sensor unit 550 is an example of a sensor unit that generates a signal that represents a density of at least a part of the toner image transferred to the recording medium.

Figure 3:
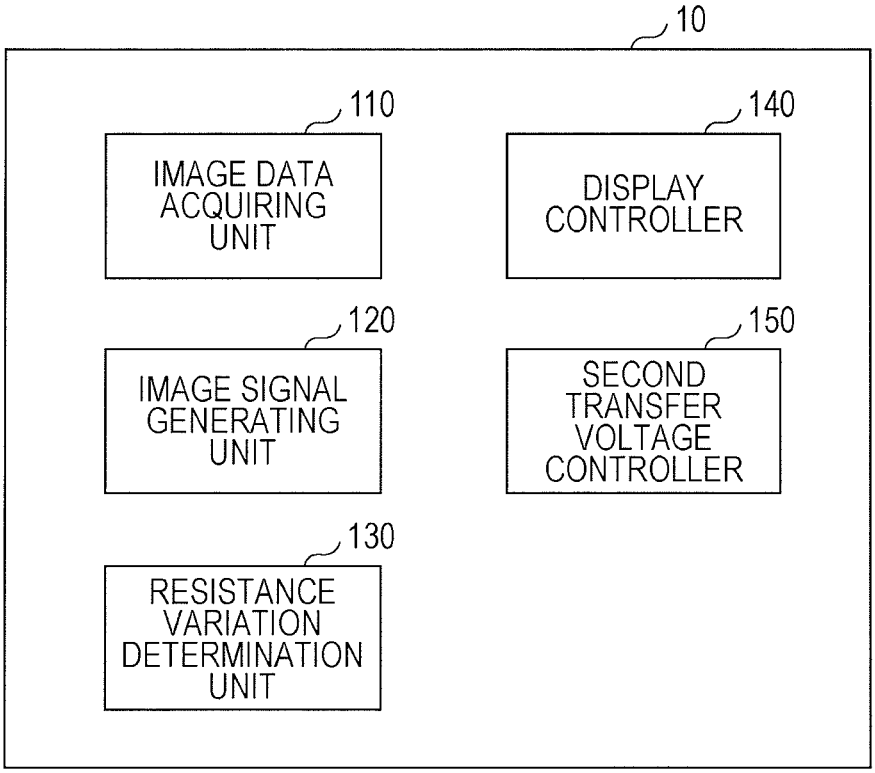
FIG. 3 is a functional block diagram illustrating functions of a controller.

FIG. 3 is a functional block diagram illustrating functions performed by the controller 10. As illustrated in FIG. 3, in the present exemplary embodiment, the controller 10 includes an image data acquiring unit 110, an image signal generating unit 120, a resistance variation determination unit 130, a display controller 140, and a second transfer voltage controller 150. These functional units are implemented in programs that are stored in the ROM and the storage unit 20 and executed by the controller 10.

The image data acquiring unit 110 acquires image data that is sent from an external apparatus such as a personal computer through the communication unit 30 or that is stored in a storage medium (not shown) such as a USB memory, and outputs the acquired image data to the image signal generating unit 120. When a user selects a resistance variation determination mode of the image forming apparatus 1, the resistance variation determination unit 130 determines whether the in-plane resistance variation of a recording medium set in the sheet feeder 501*a* or 501*b* is larger than a predetermined value, and outputs information representing the determination result to the image signal generating unit 120. The image signal generating unit 120 generates image signals corresponding to the toners on the basis of the image data input from the image data acquiring unit 110 and the information representing the determination result input from the resistance variation determination unit 130, and outputs the image signals to the image forming unit 50. The display controller 140 controls an image displayed on the display device of the operation unit 40. The second transfer voltage controller 150 controls the second transfer voltage generated between the second transfer roller 507 and the intermediate transfer belt 505 by outputting, to the image forming unit 50, a control signal for controlling the second transfer voltage applied to the second transfer roller 507.

Operation

Next, the operation of the image forming apparatus 1 will be described. The image forming apparatus 1 according to the present exemplary embodiment has a normal operation mode and a resistance variation determination mode.

Resistance Variation Determination Mode

Figure 4:
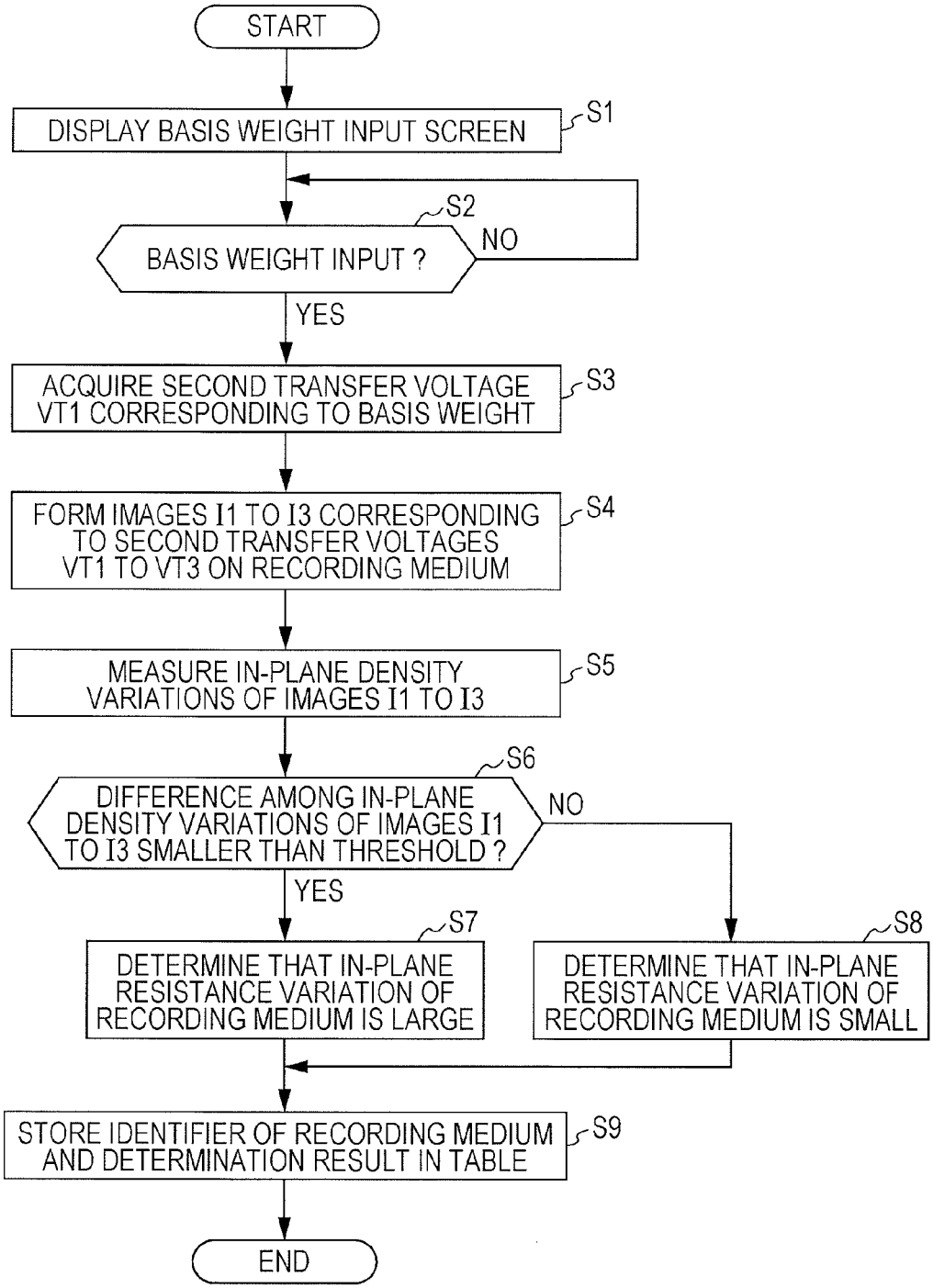
FIG. 4 is a flowchart illustrating a method of determining in-plane resistance variation of a recording medium.

FIG. 4 is a flowchart illustrating a method of determining the in-plane resistance variation of a recording medium according to the present exemplary embodiment. The process illustrated in FIG. 4 is started, for example, when a user sets a recording medium to be used in the sheet feeder 501*a* or 501*b*, and selects the resistance variation determination mode by operating the operation unit 40. The selection of the resistance variation determination mode is enabled, for example, by providing a hardware button for selecting the resistance variation determination mode on the operation unit 40 and detecting that a user presses the hardware button or by displaying a software button on the display device of the operation unit 40 and detecting that a user touches a position at which the software button is displayed.

In step S1, the display controller 140 displays a screen that prompts a user to input the basis weight of the recording medium, whose resistance variation is to be determined, on the display device of the operation unit 40. If the controller 10 determines in step S2 that the basis weight has been input by the user through the operation unit 40, the process proceeds to step S3.

In step S3, the second transfer voltage controller 150 acquires a second transfer voltage VT1 determined in accordance with the input basis weight. The voltage VT1 may be calculated on the basis of a predetermined formula. Alternatively, the second transfer voltage VT1 determined in accordance with the input basis weight may be acquired by referring a table that is stored in the storage unit 20 beforehand and that stores correspondence between the values of the basis weight and the values of the second transfer voltage.

In step S4, the image signal generating unit 120 sends a reference density image signal used for determining the resistance variation to the image forming unit 50, and the image forming unit 50 forms an image on the recording medium set in the sheet feeder 501*a* or 501*b* on the basis of the reference density image signal. The reference density image signal is a signal indicating that, for example, single-colored (for example, cyan) images having a predetermined density (for example, a density of 100% assuming that the maximum density available with the image forming apparatus 1 is 100%) are to be formed in plural regions of one recording medium without using a transparent toner. That is, if a toner transfer failure does not occur, the images formed in the regions of the recording medium on the basis of the reference density image signal have no density variation. In this example, the reference density image signal is a signal indicating that cyan single-color images having a density of 100% are to be formed in three regions (first to third regions) of one recording medium. On the basis of such a reference density image signal, the toner image forming unit 504C of the image forming unit 50 forms three cyan single-color toner images and transfers the toner images to the intermediate transfer belt 505. The second transfer unit transfers the toner images, which have been transferred to the intermediate transfer belt 505, to the recording medium.

In step S4, when forming the images in the first to third regions of the recording medium, the second transfer voltage controller 150 controls the second transfer voltage as follows. When transferring a toner image from the intermediate transfer belt 505 to the first region of the recording medium, the second transfer voltage is set at VT1, which has been acquired in step S2. When transferring a toner image to the second region, the second transfer voltage is set at VT2 that is lower than VT1. When transferring a toner image is to the third region, the second transfer voltage is set at VT3 that is higher than VT1. Thus, as illustrated in FIG. 5, three images I1 to I3 corresponding to the three second transfer voltages VT1 to VT3 are formed on one recording medium. The three images I1 to I3 on the recording medium are fixed by the fixing unit 509, and the recording medium passes the in-line sensor unit 550. At this time, the in-line sensor unit 550 generates a signal indicating two-dimensional density distributions of the images I1 to I3, and sends the signal to the resistance variation determination unit 130.

In step S5, on the basis of the signal from the in-line sensor unit 550, the resistance variation determination unit 130 measures the variation of the density of each of the images I1 to I3, which have been formed in step S4, in an in-plane direction of the recording medium (hereinafter referred to as "in-plane density variation"). To be specific, the variance of the two-dimensional density distribution of each of the image I1 to I3 (i.e., the variance of densities at plural points that are distributed two-dimensionally in the images I1 to I3) is obtained as a value representing the in-plane density variation of each of the images I1 to I3. The variance of the two-dimensional density distribution of each of the images I1 to I3 is an example of a characteristic value representing the density variation at plural points in each of the images I1 to I3.

FIG. 6 is a graph illustrating an example of a measurement result of the in-plane density variation when high-quality paper (basis weight=82 g/m$^2$) and Japanese paper (basis weight=82 g/m$^2$) are used as the recording medium. (In this example, the in-plane density variation is the variance of the two-dimensional density distribution of each of the images I1 to I3). In this example, the second transfer voltage VT1 determined in accordance with the basis weight (82 g/m$^2$) is 2.0 kV, the voltage VT2 lower than voltage VT1 is 1.0 kV, and the voltage VT3 higher than voltage VT1 is 3.0 kV.

As illustrated in FIG. 6, when high-quality paper is used as the recording medium and the second transfer voltage is VT2 or VT3, the in-plane density variation is large. In contrast, when the second transfer voltage is VT1 determined in accordance with the basis weight of the recording medium, the density variation is negligibly small. This is interpreted as follows. When high-quality paper, which has a small in-plane resistance variation, is used as the recording medium and the second transfer voltage is set at VT1 determined in accordance with the basis weight, toner that has been transferred to the intermediate transfer belt 505 is transferred to the recording medium without a transfer failure or with only a slight transfer failure, whereby the obtained image (I1) has only a small in-plane density variation. In contrast, when the second transfer voltage is set at VT2 or VT3, a shortage in the electric field used to transfer the toner or discharge may occur in the regions on which the image I2 or I3 are to be formed, whereby parts to which the toner is not normally transferred to the recording medium may be generated randomly. As a result, a density difference may arise between a part of the recording medium to which the toner is normally transferred and a part of the recording medium to which the toner is not normally transferred (that is, part or all of the toner to be transferred to the latter part of the recording medium remains on the intermediate transfer belt 505). Thus, when high-quality paper is used as the recording medium, there is a large difference between (the absolute values of) the in-plane density variation of an image formed on the recording medium on the basis of the reference density image signal when the second transfer voltage is set at V1 determined in accordance with the basis weight and the in-plane density variation of an image formed on the recording medium when the second transfer voltage is set at VT2, which is lower than VT1, or at VT3, which is higher than VT3.

On the other hand, when Japanese paper is used as the recording medium, the in-plane density variations are large in all three cases where the second transfer voltage is VT1, VT2, and VT3, and there is substantially no difference between the in-plane density variations in these cases. This is interpreted as follows. When Japanese paper, which has a large in-plane resistance variation, is used as the recording medium and the second transfer voltage is set at VT2, which is lower than VT1 determined in accordance with the basis weight, an appropriate voltage (or electric field) is generated between the recording medium and the intermediate transfer belt 505 and the toner is normally transferred to a part of the recording medium having a low resistance. However, the toner is not normally transferred to a part of the recording medium having a high resistance, because the voltage is insufficient. Therefore, a density difference arises between the part having a high resistance and the part having a low resistance, which leads to a large in-plane density variation. When the second transfer voltage is set at VT3, which is higher than VT1 determined in accordance with the basis weight, an appropriate voltage is generated between the recording medium and the intermediate transfer belt 505 and the toner is normally transferred to a part of the recording medium having a high resistance. However, the toner is not normally transferred to a part of the recording medium having a low resistance, because the voltage is too high and discharge occurs. Therefore, a density difference arises between the part having a high resistance and the part having a low resistance, which leads to a large in-plane density variation. When the second transfer voltage is set at VT1 determined in accordance with the basis weight, transfer failures may randomly occur in a part having a low resistance and a part having a high resistance. Also in this case, a large in-plane density variation occurs in an obtained image. Thus, when Japanese paper is used as the recording medium, there is only a small difference between (the absolute values of) the in-plane density variation of an image formed on the recording medium on the basis of the reference density image signal when the second transfer voltage is set at V1 determined in accordance with the basis weight and the in-plane density variation of an image formed on the recording medium on the basis of the reference density image signal when the second transfer voltage is set at VT2, which is lower than VT1, or at VT3, which is higher than VT1.

In the present exemplary embodiment, whether the in-plane resistance variation of a recording medium is larger than a predetermined value is determined on the basis of the relationship between the in-plane resistance variation of the recording medium and the in-plane density variation of an image formed on the recording medium on the basis of the reference density image signal. To be specific, in step S6 of the flowchart illustrated in FIG. 4, the resistance variation determination unit 130 determines whether (the absolute value of) the difference between the maximum value and the minimum value of the in-plane density variations of the images I1, I2, and I3, which have been obtained in step S5, is smaller than a predetermined threshold. If the difference is smaller than the threshold ("YES" in step S6), the resistance variation determination unit 130 determines that the in-plane resistance variation of the recording medium is larger than the predetermined value (step S7). If the difference is equal to or larger than the threshold ("NO" in step S6), the resistance variation determination unit 130 determines that the in-plane resistance variation of the recording medium is equal or smaller than the predetermined value (step S8). That is, in this case, the in-plane density variations of the images I1, I2, and I3 obtained in step S5 or the signal representing the two-dimensional density distributions of the images I1 to I3, which are transmitted from the in-line sensor unit 550 and used for calculating the in-plane density variations of the images I1, I2, and I3 correspond to an example of characteristic information that represents a characteristic of in-plane resistance variation of the recording medium.

After determining the in-plane resistance variation of the recording medium in steps S7 and S8, the process proceeds to step S9. In step S9, the controller 10 stores, in a table, correspondence between an identifier of the recording medium (such as a number that is automatically allocated by the controller 10 or the product name of the recording medium input by a user) and information representing whether the in-plane resistance variation of the recording medium is larger than a predetermined value (such as a flag having a value 0 if the in-plane resistance variation is larger than the predetermined value and having a value 1 if the in-plane resistance variation is equal to or smaller than the predetermined value), and finishes the resistance variation determination mode. (That is, the image forming apparatus 1 enters a normal operation mode.)

FIG. 7 illustrates a table T1, which is an example of such a table. The table T1 illustrated in FIG. 7 is stored in the storage unit 20. Alternatively, the table T1 may be stored in an external apparatus that is accessible through the communication unit 30. The table T1 illustrated in FIG. 7 stores correspondence among a number allocated by the controller 10, the product names of recording media, and values of a flag representing whether the in-plane resistance variation of the recording medium is larger than a predetermined value. Information for identifying a recording medium, such as the manufacturer's name, the properties of the recording medium (for example, size and basis weight), or the like may be stored in the table.

When, for example, a user sets a recording medium in the sheet feeder 501*a* or 501*b*, the controller 10 accesses the storage unit 20 or the external apparatus and refers to the table T1 and displays the content of the table T1 on the display device of the operation unit 40 before the user selects the resistance variation determination mode. If information representing the in-plane resistance variation of the recording medium set in the sheet feeder 501*a* or 501*b* has been stored in the table T1, the user operates the operation unit 40 and specifies the recording medium by, for example, inputting the number allocated to the recording medium in the table T1. When the recording medium is specified, the resistance variation determination unit 130 of the controller 10 refers to the table T1 and obtains the value of the flag corresponding to the specified recording medium, and determines whether the in-plane density variation of the recording medium is larger than a predetermined value on the basis of the value of the flag. In this case, the value of the flag, which is stored in the table T1 and represents whether the in-plane resistance of the recording medium is larger than the predetermined value, is an example of characteristic information that represents a characteristic of the in-plane resistance variation of the recording medium.

Normal Operation Mode

As described above, when the image forming apparatus 1 is in the normal operation mode, the image signal generating unit 120 generates image signals corresponding to the toners on the basis of the image data, which is input from the image data acquiring unit 110, and the determination result related to the in-plane resistance variation of the recording medium, which is input from the resistance variation determination unit 130.

Figure 8:
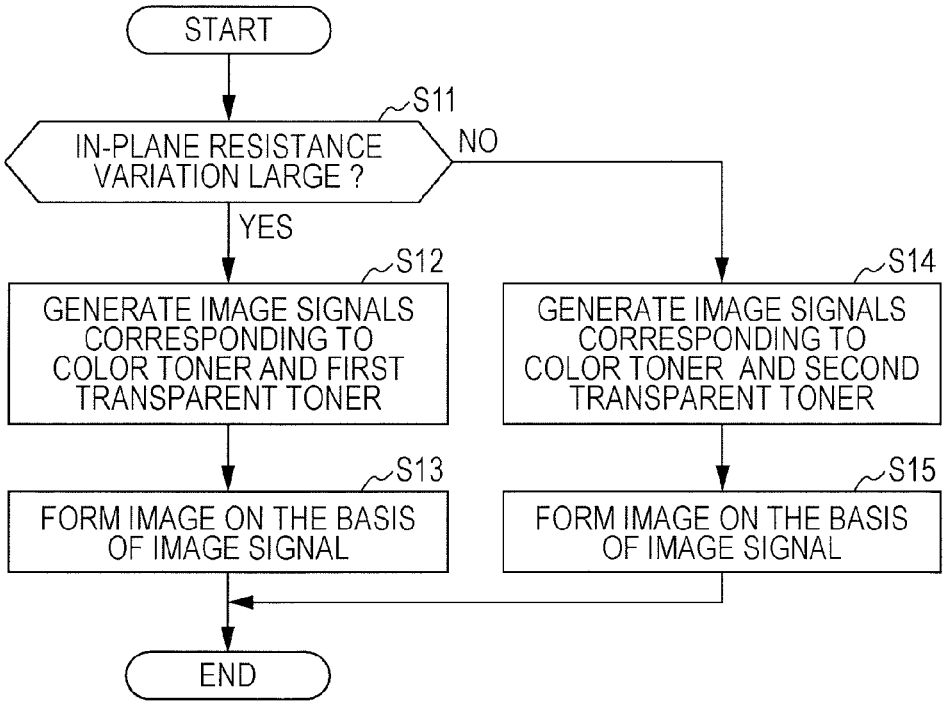
FIG. 8 is a flowchart illustrating an operation of the image forming apparatus in a normal operation mode.

FIG. 8 is a flowchart illustrating an operation of the image forming apparatus 1 in the normal operation mode. In step S11, the image signal generating unit 120 determines whether the information representing the determination result, which is input from the resistance variation determination unit 130, indicates that the in-plane resistance variation of the currently-used recording medium is large. If the image signal generating unit 120 determines that the information representing the determination result, which is input from the resistance variation determination unit 130, indicates that the in-plane resistance variation of the currently-used recording medium is large ("YES" in step S11), the process proceeds as follows. In step S12, the image signal generating unit 120 performs color separation of the image data that is input from the image data acquiring unit 110 and generates image signals corresponding to yellow (Y), magenta (M), cyan (c), and black (K). Moreover, the image signal generating unit 120 generates an image signal corresponding to the first transparent toner so that the first transparent toner, which has a viscoelasticity higher than that of the color toners, forms an image that covers the entire surface of the recording medium (from which a margin may be excluded). In step S13, the image forming unit 50 forms an image on the recording medium on the basis of the image signals sent from the image signal generating unit 120. At this time, the second transfer voltage controller 150 sets a comparatively low second transfer voltage that enables a toner image to be normally transferred to a part of the recording medium having a low resistance (for example, a voltage VT2, which is lower than the voltage VT1 determined in accordance with the basis weight).

Because the first transparent toner image forming unit 504T1 of the image forming unit 50 is disposed upstream of the color toner image forming units 504Y, 504M, 504C, and 504K in the direction in which the intermediate transfer belt 505 moves, the transparent toner image formed by the first transparent toner is transferred to the intermediate transfer belt 505 before the toner images formed by the color toners are transferred to the intermediate transfer belt 505. Therefore, the transparent toner image formed by the first transparent toner forms the lowermost layer (a layer closest to the intermediate transfer belt 505) on the intermediate transfer belt 505, and the toner images formed by the color toners are superposed on the transparent toner image. The toner images transferred to the intermediate transfer belt 505 are transported to the second transfer unit as described above, and the second transfer unit transfers the toner images to the recording medium. As a result, the transparent toner image formed by the first transparent toner forms the uppermost layer on the recording medium.

Figure 9:
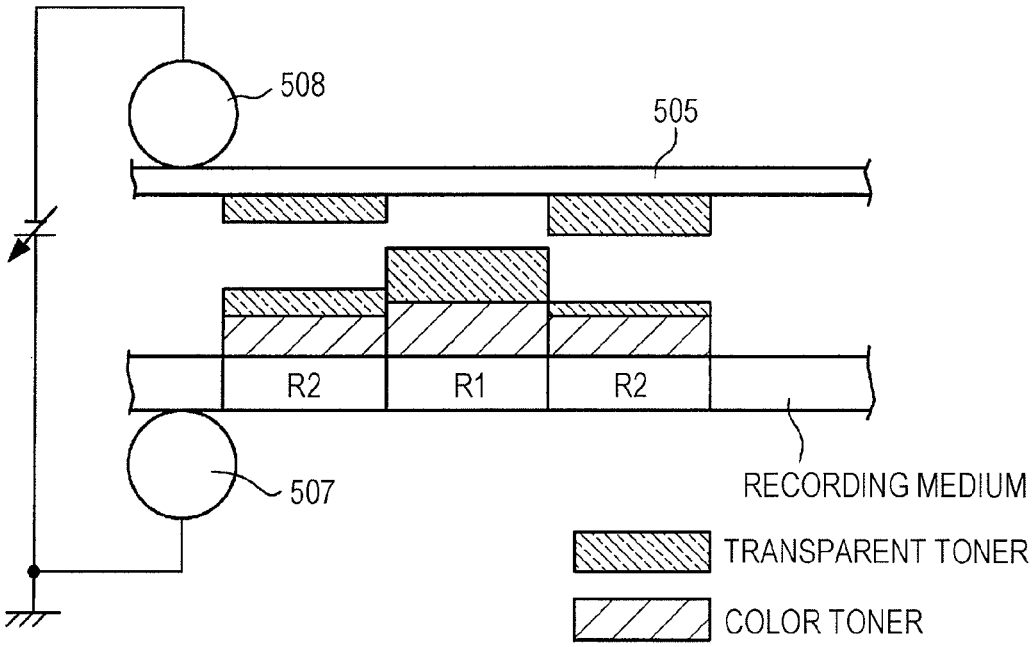
FIG. 9 is a schematic sectional view illustrating an intermediate transfer belt and a recording medium after a second transfer.

FIG. 9 is a schematic sectional view illustrating the intermediate transfer belt 505 and a recording medium after the second transfer is finished. This second transfer is performed under the following condition: a comparatively low voltage that is suitable for a part of the recording medium having a low resistance is set as the second transfer voltage, a transparent toner and a color toner are used, and a recording medium having a resistance variation is used. In FIG. 9, a region R1 is a part of the recording medium having a low resistance and a region R2 is a part of the recording medium having a high resistance.

As illustrated in FIG. 9, all toners, including the transparent toner, are normally transferred from the intermediate transfer belt 505 to the region R1 of the recording medium, because the region R1 having a low resistance is subjected to an appropriate transfer electric field. That is, no toner remains on the intermediate transfer belt 505. The color toner is entirely transferred to the region R2 of the recording medium, while a part of the transparent toner remains on the intermediate transfer belt 505 because the region R2 having a high resistance is subjected to an insufficient transfer electric field. In other words, the transparent toner serves to reduce adhesion of the color toner to the intermediate transfer belt 505 and thereby assists the transfer of the color toner. Thus, even if a recording medium having a large resistance variation is used, the color toner is normally transferred from the intermediate transfer belt 505 to all parts of the recording medium by using the transparent toner and by setting a voltage that is suitable for a part of a recording medium having a low resistance as the second transfer voltage (for example, a voltage VT2 lower than the voltage VT1 determined in accordance with the basis weight). Note that, although one color toner is used in the example illustrated in FIG. 9, plural (any of Y, M, C, and K toners) may be used. As illustrated in FIG. 9, the amount of the transparent toner transferred to the recording medium has variation in the in-plane direction of the recording medium.

Figure 10:
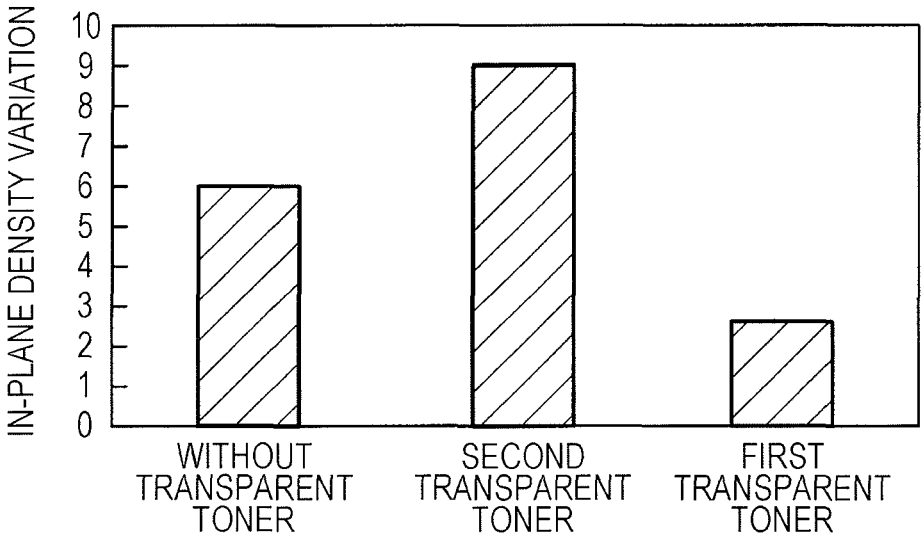
FIG. 10 is a graph illustrating in-plane density variation of an image formed on Japanese paper in a case where a transparent toner is not used, a case where a second transparent toner is used, and a case where a first transparent toner is used.

FIG. 10 is a graph illustrating the in-plane density variation of an image formed on Japanese paper in the following three cases: (1) a case where a transparent toner is not used, (2) a case where a second transparent toner having a viscoelasticity substantially the same as that of the color toners is used as the transparent toner, and (3) a case where a first transparent toner having a viscoelasticity higher than that of the color toners is used. In each of these cases, the second transfer voltage is set at the voltage VT2, which is lower than the voltage VT1 determined in accordance with the basis weight, and a single-color cyan image having a density of 100% is formed on Japanese paper.

As illustrated in FIG. 10, when the second transparent toner having substantially the same viscoelasticity as the color toners is used as the transparent toner, the density variation of an obtained image is larger than that when a transparent toner is not used. This is interpreted as follows. When the transparent toner is used in order to improve transfer of a color toner to the recording medium, the variation of the transfer of the color toner is reduced. However, because the amount of the transparent toner transferred to the recording medium has variation as illustrated in FIG. 9, variation of gloss due to the variation of the transferred amount of the transparent toner is detected as a density variation of the image.

In contrast, the density variation of an image obtained by using the present exemplary embodiment (in which the first transparent toner is used) is reduced as compared with the case where a transparent toner is not used. The transferred amount of the transparent toner has variation also when the present exemplary embodiment is used. However, higher the viscoelasticity of a toner, smaller the variation in gloss relative to the transferred amount of the toner. Therefore, with the present exemplary embodiment, in which the first transparent toner having a viscoelasticity higher than that of the color toners is used, it is unlikely that the variation of the transferred amount of the first transparent toner is detected as a variation of gloss. Accordingly, the density variation of the image is smaller than that in the case where the second transparent toner is used. That is, the present exemplary embodiment uses the first transparent toner, which has a viscoelasticity higher than that of the color toner, for a recording medium having a large in-plane resistance variation such as Japanese paper, and thereby reduces variation of the transferred amount of the color toner due to the in-plane resistance variation of the recording medium and suppresses variation of gloss due to the variation of the transferred amount of the first transparent toner on the recording medium. As a result, the density variation of an obtained image is reduced. Because the viscoelasticity of the first transparent toner is higher than that of the color toners, the gloss of an image formed on the recording medium is influenced by only the first transparent toner, which forms the uppermost layer on the recording medium, and is not influenced by the color toner. The viscoelasticity (storage modulus) of the first transparent toner may be equal to or higher than twice the viscoelasticity (storage modulus) of the color toners at the same temperature.

Referring back to FIG. 8, if it is determined in step S11 that the determination result, which is input from the resistance variation determination unit 130, indicates that the in-plane resistance variation of the recording medium is small ("NO" in step S11), the process proceeds as follows. In step S14, the image signal generating unit 120 generates image signals corresponding to yellow (Y), magenta (M), cyan (c), and black (K) from the image data that is input from the image data acquiring unit 110. Moreover, the image signal generating unit 120 generates an image signal corresponding to the second transparent toner so that the second transparent toner, which has a viscoelasticity corresponding to that of the color toners, forms an image. In step S15, the image forming unit 50 forms an image on the recording medium on the basis of an image signal sent from the image signal generating unit 120. The toner image may be formed by the second transparent toner so as to correct, for example, the variation of the height of the toner images formed by the color toners (i.e., the amount of the second transparent toner is small in a part where the height of the color toner layers is large, and the amount of the second transparent toner is large in a part where the height of the color toner layers is small). As described above, when a recording medium having a low in-plane resistance variation such as high-quality paper is used, the toners, including the transparent toner, are normally transferred from the intermediate transfer belt 505, so that unintentional variation of the transferred amount of the transparent toner does not occur on the recording medium. As described above, the composition of the second transparent toner may be the same as that of the color toners except that the second transparent toner does not include a coloring agent. However, the composition of the second transparent toner is not limited thereto. The second transparent toner may have any composition as long as (the absolute value of) the difference between the storage modulus (viscoelasticity) of the second transparent toner and the storage modulus of the color toners is smaller than (the absolute value of) the difference between the storage modulus (viscoelasticity) of the first transparent toner and the storage modulus of the color toners and the variation of gloss due to variation of the height of the color toner images are corrected by using the second transparent toner. Note that this gloss control using the second transparent toner may be omitted.

Modification

The exemplary embodiment described above may be modified as follows. The following modifications may be used in combination.

First Modification

In the exemplary embodiment described above, single-color images having a predetermined density (for example, cyan images having a density of 100%) are formed in plural regions of the recording medium by applying different second transfer voltages (VT1, VT2, and VT3) without using a transparent toner. If the density variation of the images (I1, I2, and I3) is within a predetermined range, it is determined that the in-plane resistance variation of the recording medium is larger than a predetermined value. The present invention is not limited thereto. For example, the in-plane resistance variation of a recording medium may be determined in the following way.

Figure 11:
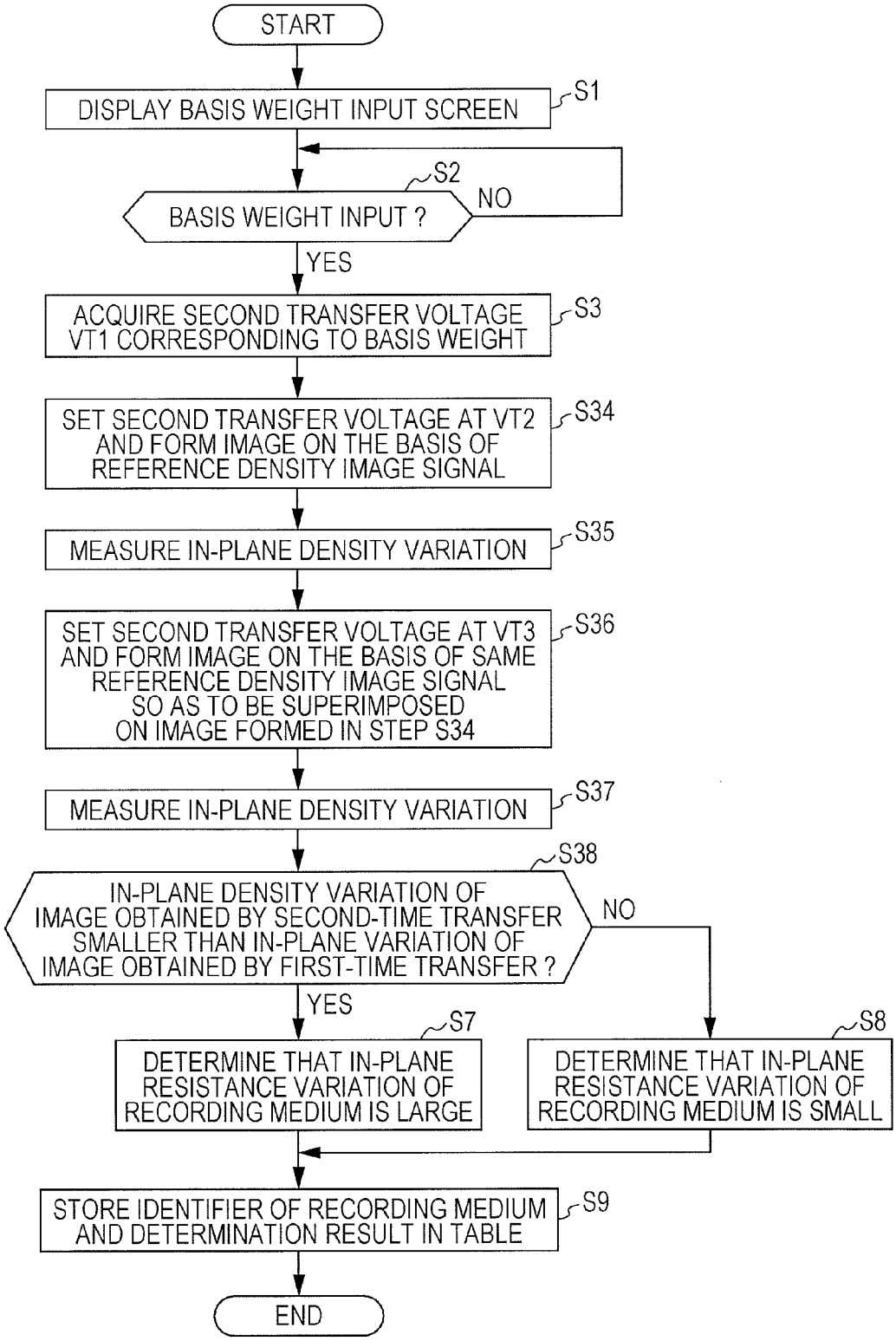
FIG. 11 is a flowchart illustrating a method of determining the in-plane resistance variation of a recording medium according to a first modification.

FIG. 11 is a flowchart illustrating a method of determining the in-plane resistance variation of a recording medium according to the first modification. In FIG. 11, the steps the same as those of FIG. 4 are denoted by the same numerals and detailed description thereof will be omitted.

In step S3, the second transfer voltage VT1 determined in accordance with the basis weight is acquired. In step S34, the image signal generating unit 120 sends a reference density image signal for determining the resistance variation to the image forming unit 50, and the image forming unit 50 forms an image (first image) on the recording medium on the basis of the reference density image signal. In the present modification, the reference density image signal is a signal indicating that a cyan single-color image having a density of 100% is to be formed in a predetermined region of the recording medium (for example, the entire region of the recording medium excluding a margin). The toner image forming unit 504C of the image forming unit 50 forms the cyan single-color toner image on the basis of the reference density image signal, and transfers the toner image to the intermediate transfer belt 505. The second transfer unit transfers the toner image from the intermediate transfer belt 505 to the recording medium. Moreover, in step S34, the image forming unit 50 sets the second transfer voltage at VT2, which is lower than the voltage VT1 determined in accordance with the basis weight.

In step S35, the resistance variation determination unit 130 calculates the in-plane density variation of the image formed in step S34 on the basis of a signal from the in-line sensor unit 550 (i.e., a signal representing the two-dimensional density distribution of the image formed in step S34). Also in the present modification, the in-plane density variation is calculated as the variance of two-dimensional density distribution of the image formed on the recording medium.

In step S36, the image forming unit 50 forms an image on the basis of the reference density image signal the same as that used in step S34 so as to be superimposed on the image that has been formed on the recording medium in step S34. That is, the toner image forming unit 504C of the image forming unit 50 forms a cyan single-color toner image on the basis of the same reference density image signal and transfers the image to the intermediate transfer belt 505. The second transfer unit transfers the toner image from the intermediate transfer belt 505 so as to be superimposed on the image that has been formed on the recording medium in step S34 (the image obtained after the second-time transfer will be referred to as the second image). In step S36, the image forming unit 50 sets the second transfer voltage at VT3, which is higher than VT1 determined in accordance with the basis weight. The operation of forming and superimposing the image on the image that has been formed on the recording medium may be performed by returning the recording medium on which the image has been formed to the second transfer unit by using a known medium-reversing mechanism (not shown). Alternatively, a user return the recording medium to the sheet feeder 501*a* or 501*b* after the recording medium has been output to the output tray 511 after the first-time second transfer.

In step S37, the resistance variation determination unit 130 measures the in-plane density variation of the image formed in step S36 on the basis of a signal from the in-line sensor unit 550 (i.e., a signal representing the two-dimensional density distribution of the image formed in step S36).

Figure 12:
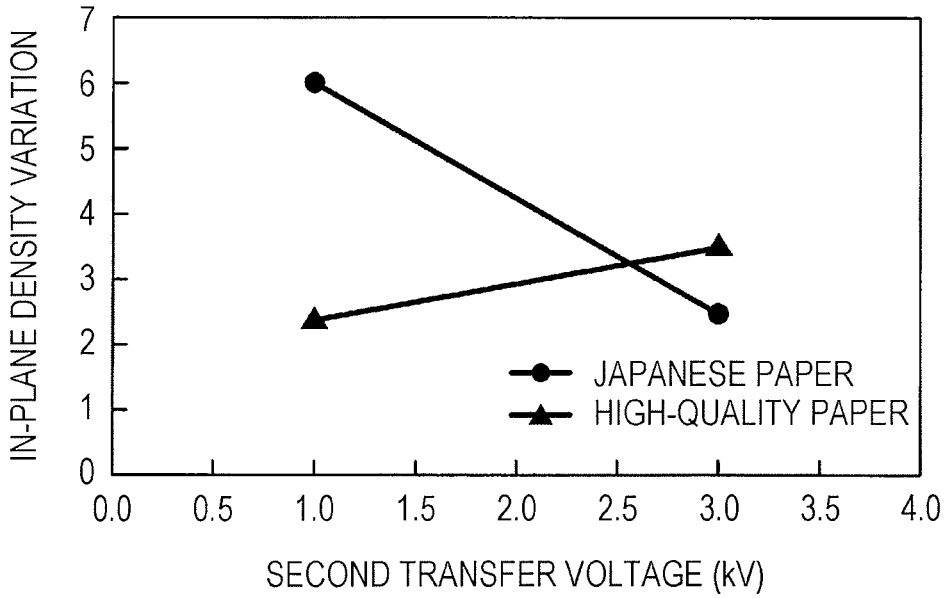
FIG. 12 is a graph illustrating the in-plane density variation after the first-time transfer and the in-plane density variation after the second-time transfer when transfer is performed twice at different second transfer voltages onto the same surface of each of Japanese paper and high-quality paper so as to form images that overlap.

FIG. 12 is a graph illustrating the in-plane density variation after the first-time transfer and the in-plane density variation after the second-time transfer when transfer is performed twice at the different second transfer voltages onto the same surface of each of Japanese paper (basis weight=82 g/m$^2$) and high-quality paper (basis weight=82 g/m$^2$) so as to form images that overlap. In this example, as with the exemplary embodiment described above, the second transfer voltage VT1 determined in accordance with the basis weight (82 g/m$^2$) is 2.0 kV, the voltage VT2 lower than the voltage VT1 is 1.0 kV, and the voltage VT3 higher than voltage VT1 is 3.0 kV. As illustrated in FIG. 12, in the case of Japanese paper, the in-plane density variation after the second-time transfer is substantially smaller than the in-plane density variation after the first-time transfer. This is interpreted as follows. Japanese paper has a large in-plane resistance variation. Therefore, in the first-time transfer, which is performed with a relatively low second transfer voltage VT2, a part of the recording medium having a low resistance is subjected to an appropriate electric field and the toner is appropriately transferred in the part, while a part of the recording medium having a high resistance is subjected to an insufficient electric field and density variation occurs in the part. When the second-time transfer is performed at a relatively high second transfer voltage VT3, the part of the recording medium having a high resistance is subjected to an appropriate electric field and the toner is appropriately transferred. The electric field weakens before the second-time transfer due to discharge, so that the toner is not appropriately transferred to the part having a low resistance in the second transfer. However, the toner has been transferred to the part in the first transfer. That is, in the case of Japanese paper, by performing transfer twice at different second transfer voltages, the toner is transferred to the part having a low resistance and to the part having a high resistance. As a result, the in-plane density variation of an image after the second-time transfer is smaller than that after the first-time transfer.

In contrast, in the case of high-quality paper, the in-plane density variation after the second-time transfer is not smaller than that after the first-time transfer. This is interpreted as follows. The high-quality paper has a small in-plane resistance variation. Therefore, in the first-time transfer, which is performed with a relatively low second transfer voltage VT2, randomly-distributed parts of the recording medium are subjected to an appropriate electric field and transfer failure of the toner randomly occurs in the image forming region, whereby the in-plane density variation occurs. When the second-time transfer is performed at the relatively high second transfer voltage VT3, discharge randomly occurs in the image formation region and transfer failure of the toner randomly occurs. Thus, in the case of high-quality paper, transfer failure randomly occurs in the first-time and in the second-time transfer, so that the in-plane density variation of the image due to transfer failure is not reduced even when transfer is performed twice.

In the first modification, whether the in-plane resistance variation is larger than a predetermined value is determined on the basis of the above-described relationship between the in-plane resistance variation of the recording medium and the in-plane density variation of the image formed on the recording medium. Referring back to FIG. 11, in step S38, the resistance variation determination unit 130 determines whether the in-plane density variation of an image obtained after the second transfer is smaller than the in-plane density variation of an image obtained after the first transfer when the first-time and second-time transfer have been performed at different second transfer voltages so as to form overlapping images on the same surface of the recording medium. If the in-plane density variation of the image obtained after the second transfer is smaller than the in-plane density variation of the image obtained after the first transfer ("YES" in step S38), the resistance variation determination unit 130 determines that the in-plane resistance variation of the recording medium is larger than a predetermined value (step S7). In the in-plane density variation of the image obtained after the second transfer is equal to or larger than the in-plane density variation of an image obtained after the first transfer ("NO" in step S38), the resistance variation determination unit 130 determines that the in-plane resistance variation of the recording medium is smaller than a predetermined value (step S8). That is, in this example, the in-plane density variation of an image obtained after the first-time transfer, which is measured in step S35, and the in-plane density variation of an image obtained after the second transfer, which is measured in step S37, or a signal that is sent from the in-line sensor unit 550 and that is used for calculating these in-plane density variations correspond to an example of characteristic information that represents a characteristic of the in-plane resistance variation of the recording medium.

After determining the in-plane resistance variation of the recording medium in steps S7 and S8, the process proceeds to step S9. In step S9, the controller 10 stores correspondence between an identifier of a recording medium and information representing whether the in-plane resistance variation of the recording medium is larger than a predetermined value in the table T1 illustrated in FIG. 7 and finishes the resistance variation determination mode.

In the first modification described above, the second transfer voltage for the first-time transfer may be set at VT3, which is higher than VT1 determined in accordance with the basis weight, and the second transfer voltage for the second transfer may be set at VT2, which is lower than VT1 determined in accordance with the basis weight.

Second Modification

In the exemplary embodiment described above, when the resistance variation determination mode is selected by a user's operation on the operation unit 40, whether the in-plane resistance variation of a recording medium is larger than a predetermined value is determined by forming an image on the recording medium by the image forming unit 50 on the basis of the reference density image signal and by analyzing the formed image. However, determination of the in-plane resistance variation of a recording medium according to the present invention is not limited to the determination performed in the resistance variation determination mode.

For example, the in-plane resistance variations of various recording media may be measured in a factory beforehand, and a table (for example, the table T1 illustrated in FIG. 7) that stores correspondence between the identifier (for example, the product name) of the recording media and a flag (which is an example of characteristic information) representing whether the in-plane resistance variation of each of the recording media is larger than a predetermined value may be stored, for example, in the storage unit 20 or in an external apparatus that is connected through the communication unit 30. When, for example, a user sets a recording medium in the sheet feeder 501*a* or 501*b*, the controller 10 displays the content of the table on the display device of the operation unit 40. Then, the user may specify the recording medium set in the sheet feeder 501*a* or 501*b* among the displayed recording media by operating the operation unit 40. When the user specifies the recording medium, the resistance variation determination unit 130 refers to the table and acquires the value of the flag corresponding to the recording medium and determines whether the in-plane resistance variation of the recording medium is larger than a predetermined value.

In this case, if the value of the flag corresponding to the recording medium that the user has set in the sheet feeder 501*a* or 501*b* is not stored in the table, the user may select the resistance variation determination mode described above. (For example, a button for selecting the resistance variation determination mode may be displayed on the display device of the operation unit 40). If the user selects the resistance variation determination mode and the determination result of the in-plane resistance variation of the recording medium is obtained in the resistance variation determination mode, the controller 10 additionally stores a correspondence between the identifier of the recording medium and information representing the determination result in the table.

The information stored in the table and representing the characteristic of the in-plane resistance variation of the recording medium is not limited to the flag representing whether the in-plane resistance variation of the recording medium is larger than a predetermined value. Any information may be used as long as the information represents the characteristic of the in-plane resistance variation of the recording medium. Examples such information include data on two-dimensional distribution of the in-plane electrical resistance of the recording medium (in-plane resistance distribution) and the variance of the in-plane resistance distribution calculated by using the data. The recording sheet used need not be specified by operating the operation unit 40. When, for example, the image forming apparatus 1 performs printing on a request from an external apparatus such as a personal computer, the content of the table may be displayed on the external apparatus so as to allow a user to specify the recording medium by operating the external apparatus.

Third Modification

In the exemplary embodiment described above, the in-line sensor unit 550 generates a signal representing the two-dimensional density distributions of the images I1 to I3. The resistance variation determination unit 130 calculates the variances of the two-dimensional density distributions of the images I1 to I3, which represent the in-plane density variations of the images I1 to I3, and the resistance variation determination unit 130 determines whether the in-plane resistance variation of the recording medium is large on the basis of the variances. However, the present invention is not limited thereto.

For example, the in-line sensor unit 550 may generate a signal representing one-dimensional density distributions of each of the images I1 to I3 in the transport direction of the recording medium (i.e., the density of the images on plural points of the recording medium arranged in the transport direction). The resistance variation determination unit 130 may calculate the variances of the one-dimensional density distributions of the images I1 to I3 in the transport direction of the recording medium (i.e., the density of the images on plural points of the recording medium arranged in the transport direction) and the resistance variation determination unit 130 may determine whether the in-plane resistance variation of the recording medium is large on the basis of the variances. The direction in which the density distribution of an image is measured is not limited tot the transport direction of the recording medium, and may be a direction that intersects the transport direction of the sheet. The variances of the one-dimensional density distributions of the images I1 to I3 are examples of characteristic values representing the density variations at plural points on the images image I1 to I3.

The characteristic values representing the density variations at plural points of the images I1 to I3 are not limited to the variances of the one-dimensional or two-dimensional density distributions at plural points of the images I1 to I3, and may be other statistical measures representing the density variations.

Fourth Modification

In the exemplary embodiment described above, the three images I1 to I3 corresponding to the three second transfer voltages VT1 to VT3 are formed one recording medium in the resistance variation determination mode. However, the present invention is not limited to such an exemplary embodiment. For example, the three images I1 to I3 corresponding to the three second transfer voltages VT1 to VT3 may be formed on three recording media of the same type (i.e., having the same identifier (for example, the product name)). It is not necessary that the three images I1 to I3 corresponding to the three second transfer voltage VT1 to VT3 be formed. For example, two images (for example, I1 and I2) corresponding to two second transfer voltages (for example, VT1 and VT2) may be formed and the in-plane resistance variation of the recording medium may be determined on the basis of the in-plane density variations of the two images.

Fifth Modification

In the exemplary embodiment described above, the in-plane resistance variation of a recording medium is determined on the basis of the in-plane density variations of images formed on the recording medium. However, the present invention is not limited thereto. For example, as described in the paragraph [0010] of Japanese Unexamined Patent Application Publication 2007-4066 (Patent Document 1), the in-plane resistance distribution of the recording medium may be measured by using a dielectric relaxation measuring apparatus, the in-plane resistance variation of the recording medium may be calculated as the variance of the in-plane resistance distribution, and whether the calculated in-plane resistance variation is larger than a predetermined value may be determined.

Sixth Modification

In the exemplary embodiment described above, the image forming apparatus 1 is a printer. However, the image forming apparatus 1 may be a copier. In this case, the image forming apparatus 1 includes an image reader (scanner), and the image reader generates image data from a read image and sends the image data to the image data acquiring unit 110. Alternatively, the image forming apparatus 1 may be a multifunction apparatus having the functions of a printer, a copier, and a FAX.

Seventh Modification

In the exemplary embodiment described above, the basis weight of a currently-used recording medium is input by a user. However, the present invention is not limited thereto. For example, as described in paragraph [0017] of Japanese Unexamined Patent Application Publication 2009-103885 (Patent Document 4), the operation of inputting the basis weight by a user may be omitted by providing a basis weight sensor for measuring the basis weight of a recording medium stored in the sheet feeders 501*a* and 501*b*.

Eighth Modification

The controller 10 may include an application specific integrated circuit (ASIC). In this case, the functions of the controller 10 may be implemented by the ASIC or by the CPU and ASIC.

Ninth Modification

A program for causing the controller 10 to perform the functions may be stored in a computer readable recording medium and installed from the computer readable recording medium to the image forming apparatus 1. The examples of such a computer readable recording medium include a magnetic recording medium (magnetic tape, magnetic disk (HDD, flexible disk (FD)), or the like), an optical recording medium (optical disc (compact disc (CD), digital versatile disc (DVD))), a magneto-optical recording medium, and a semiconductor memory. The program may be downloaded through a communication network and installed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a toner image forming device that forms a toner image by using at least one of a plurality of toners that include a color toner and a first transparent toner that has a viscoelasticity higher than a viscoelasticity of the color toner;

an intermediate transfer body to which the toner image formed by the toner image forming device is transferred;

a second transfer unit that transfers the toner image transferred to the intermediate transfer body to a recording medium; and a controller that acquires characteristic information that represents a characteristic of in-plane resistance variation of a currently-used recording medium before the toner image forming device forms the toner image, and if the characteristic information indicates that the in-plane resistance variation of the currently-used recording medium is larger than a predetermined in-plane resistance variation value, controls the toner image forming device so that the toner image forming device forms a transparent toner image by using the first transparent toner in such a way that a color toner image formed by using the color toner is superimposed on the transparent toner image on the intermediate transfer body.

2. The image forming apparatus according to claim 1, further comprising:

a sensor unit that generates a signal that represents a density of at least a part of the toner image transferred to the recording medium by the second transfer unit, wherein the controller generates a reference density image signal indicating that a plurality of color images having a predetermined density to be formed on one or more recording media without using a transparent toner, wherein the toner image forming device forms a plurality of color toner images on the basis of the reference density image signal and transfers the plurality of color toner images to the intermediate transfer body, wherein the second transfer unit transfers the plurality of color toner images transferred to the intermediate transfer body to the one or more currently-used recording media by using different second transfer voltages and forms the plurality of color images on the one or more currently-used recording media, wherein the sensor unit sends a signal to the controller, the signal representing densities at a plurality of points in each of the plurality of color images formed on the one or more currently-used recording media by the second transfer unit, and wherein the controller calculates a characteristic value representing a density variation at the plurality of points in each of the plurality of color images on the basis of the signal from the sensor unit, and if a difference between a maximum value and a minimum value of the characteristic values for the color images is smaller than a threshold, determines that the in-plane resistance variation of the one or more currently-used recording media is larger than the predetermined value.

3. The image forming apparatus according to claim 2, wherein the different second transfer voltages include a first voltage that is determined in accordance with a basis weight of the currently-used recording medium, a second voltage that is lower than the first voltage, and a third voltage that is higher than the first voltage.

4. The image forming apparatus according to claim 1, further comprising:

a sensor unit that generates a signal that represents a density of at least a part of the toner image transferred to the recording medium by the second transfer unit, wherein the controller generates a reference density image signal indicating that a color image having a predetermined density is to be formed in a predetermined region of the recording medium without using a transparent toner, wherein a color toner unit forms a color toner image on the basis of the reference density image signal and transfers the color toner image to the intermediate transfer body, wherein the second transfer unit forms a first image on the currently-used recording medium by transferring the color toner image transferred to the intermediate transfer body to the currently-used recording medium by using a first-time second transfer voltage, wherein the color toner unit forms a new color toner image on the basis of the reference density image signal and transfers the new color toner image to the intermediate transfer body after the second transfer unit has formed the first image, wherein the second transfer unit forms a second image by transferring the new color toner image, which has been formed by the color toner unit and transferred to the intermediate transfer body, so as to be superimposed on the first image by using a second-time second transfer voltage, the second-time second transfer voltage being different from the first-time second transfer voltage, wherein the sensor unit sends a signal to the controller, the signal representing densities at a plurality of points in each of the first image and the second image, and wherein the controller calculates a first characteristic value and a second characteristic value on the basis of the signal from the sensor unit, the first characteristic value representing variation of densities at the plurality of points in the first image and the second characteristic value representing variation of densities at the plurality of points in the second image, and if the first and second characteristic values indicate that the variation of densities at the plurality of points in the second image is smaller than the variation of densities at the plurality of points in the first image, the controller determines that the in-plane resistance variation of the currently-used recording medium is larger than the predetermined value.

5. The image forming apparatus according to claim 4, wherein the first-time second transfer voltage is one of a voltage that is lower than a second transfer voltage determined in accordance with a basis weight of the currently-used recording medium and a voltage that is higher than the second transfer voltage determined in accordance with the basis weight of the currently-used recording medium, and the second-time second transfer voltage is the other of the voltage that is lower than the second transfer voltage determined in accordance with the basis weight of the currently-used recording medium and the voltage that is higher than the second transfer voltage determined in accordance with a basis weight of the currently-use recording medium.

6. The image forming apparatus according to claim 1, wherein the controller is capable of referring to a table that stores correspondence between an identifier of one or more types of recording media and characteristic information representing the in-plane resistance variation of the one or more types of recording media, and wherein, when one of the one or more types recording media that are stored in the table is specified by a user, the controller refers to the table by using the identifier of the specified type of recording medium, acquires the characteristic information corresponding to the identifier, and determines whether the in-plane resistance variation of the currently-used recording medium is larger than the predetermined value on the basis of the acquired characteristic information.

7. The image forming apparatus according to claim 1, wherein the plurality of toners further include a second transparent toner having a viscoelasticity corresponding to a viscoelasticity of the color toner, and wherein, if the in-plane resistance variation of the currently-used recording medium is equal to or smaller than the predetermined value, the controller controls the toner image forming device so that the toner image forming device forms a transparent toner image by using the second transparent toner in such a way that a color toner image formed by using the color toner is superimposed on the transparent toner image formed by using the second transparent toner on the intermediate transfer body.

8. An image forming method comprising:

forming a toner image by using at least one of a plurality of toners that include a color toner and a first transparent toner that has a viscoelasticity higher than a viscoelasticity of the color toner;

transferring the toner image formed to an intermediate transfer body;

transferring the toner image transferred to the intermediate transfer body to a recording medium;

acquiring characteristic information that represents a characteristic of in-plane resistance variation of a currently-used recording medium before the toner image is formed; and controlling, if the characteristic information indicates that the in-plane resistance variation of the currently-used recording medium is larger than a predetermined in-plane resistance variation value, the forming of the toner image so that a transparent toner image is formed by using the first transparent toner in such a way that a color toner image formed by using the color toner is superimposed on the transparent toner image on the intermediate transfer body.

* * * * *